US006102199A

United States Patent [19]

Ho

[11] Patent Number: 6,102,199

[45] Date of Patent: Aug. 15, 2000

[54] HANGTAG NOTEPAPER DISPENSER AND WRITING INSTRUMENT HOLDER

[76] Inventor: Peter Pei-Tak Ho, 3723 N. Cicero Ave., Chicago, Ill. 60641

[21] Appl. No.: 09/195,018

[22] Filed: Nov. 17, 1998

[51] Int. Cl.[7] ..... A45C 11/34

[52] U.S. Cl. ..... 206/214; 206/38; 206/486; 206/806; 40/617

[58] Field of Search ..... 206/214, 575, 206/224, 38, 486, 487, 488, 489, 490, 806, 476; 40/331, 617, 599, 107

[56] References Cited

U.S. PATENT DOCUMENTS

| | | | |
|---|---|---|---|
| D. 316,877 | 5/1991 | Mitchell | D20/22 |
| 398,669 | 2/1889 | Starkey | 206/481 |
| 1,446,741 | 2/1923 | Faber | 206/214 |
| 1,779,146 | 10/1930 | Reckford | 206/214 |
| 2,024,984 | 12/1935 | Bradley | 206/214 |
| 2,122,289 | 6/1938 | Legendre | 206/487 |
| 2,549,568 | 4/1951 | Bolding | 206/214 |
| 3,184,058 | 5/1965 | Crowther | 206/488 |
| 3,745,679 | 7/1973 | Petrie | 40/107 |
| 4,216,598 | 8/1980 | Newbert | 40/331 |
| 4,739,878 | 4/1988 | DiDomenico | 206/806 |
| 5,152,397 | 10/1992 | Mayled | 206/486 |

*Primary Examiner*—Paul T. Sewell
*Assistant Examiner*—Nhan T. Lam

[57] ABSTRACT

A thin, flat hangtag for holding notepaper and of the type having an aperture to hang onto a projection, a pair of longitudinal slits to hold a writing instrument, and at least one die-cut flap which hinges on a fold-line to open outward to support the bottom of a notepaper pad. The hangtag may contain a die-cut slit or a die-cut tongue at a predetermined space above the flap to partially accommodate the last note sheet in order to further secure the notepaper pad. In addition, the hangtag may contain one or a plurality of slits communicating outwardly from the aperture for easy mounting on a projection. Furthermore, the hangtag may contain lateral scored fold-lines across the top, the mid-section, and the bottom of the writing instrument holding slits to facilitate the ease of insertion of writing instrument.

14 Claims, 13 Drawing Sheets

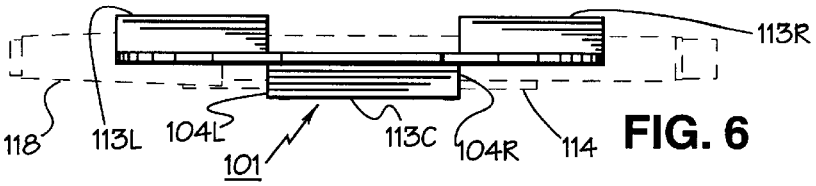
FIG. 6
FIG. 5
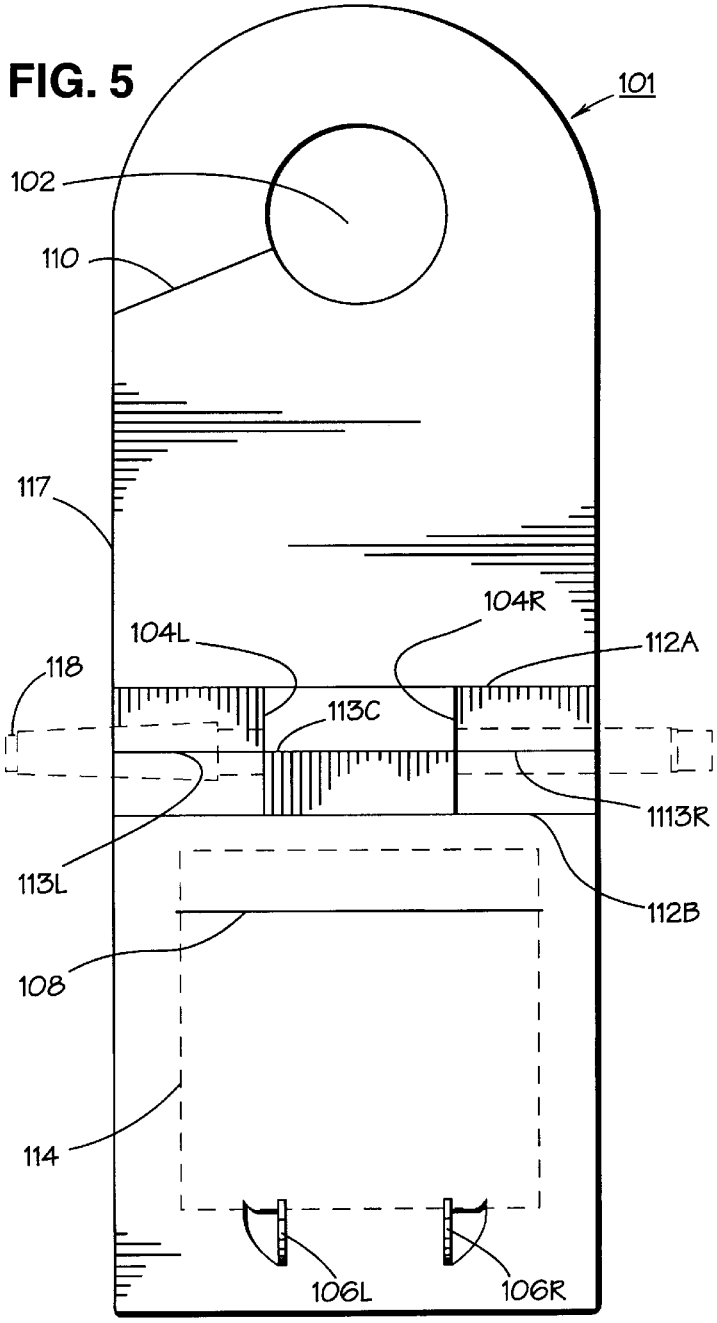
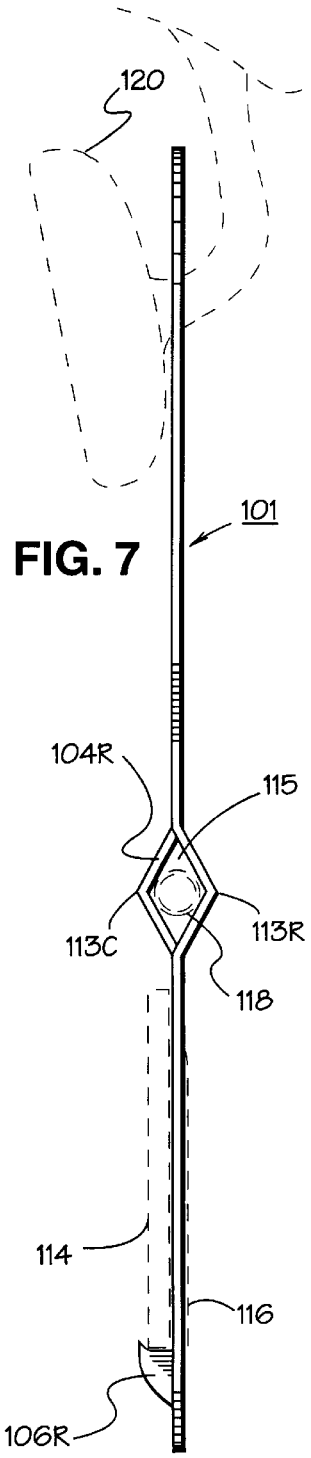
FIG. 7

200
202
204L
204R
209L
209R
206L
206R

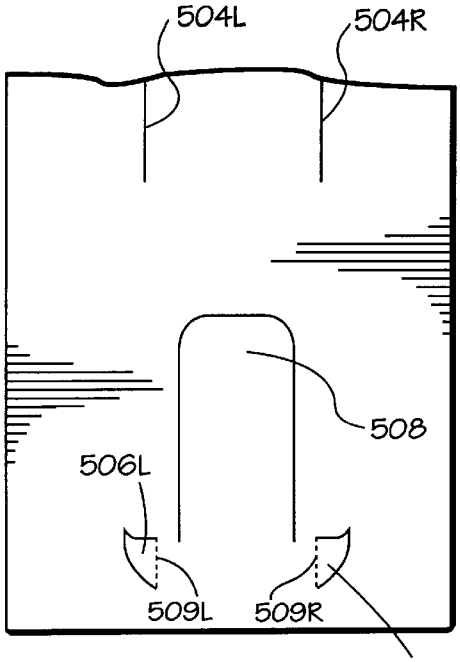
FIG. 16
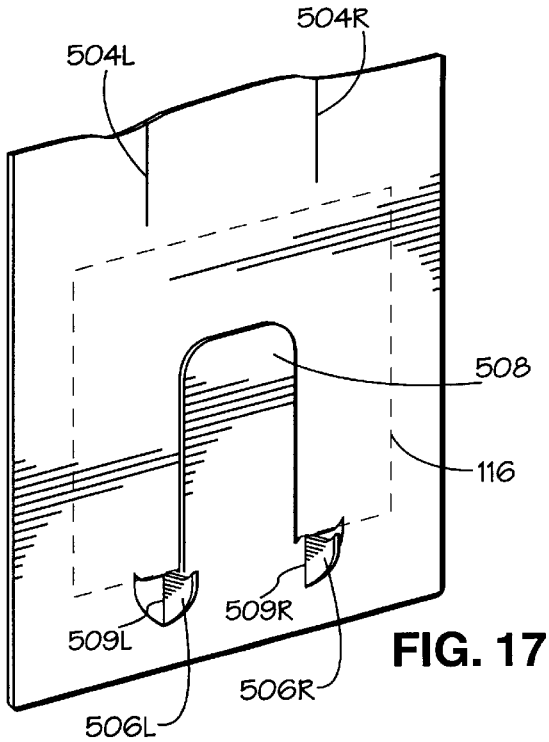
FIG. 17
FIG. 18
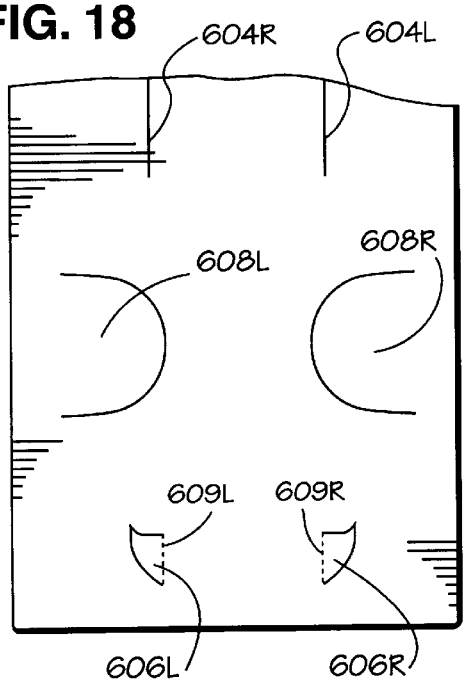
FIG. 19
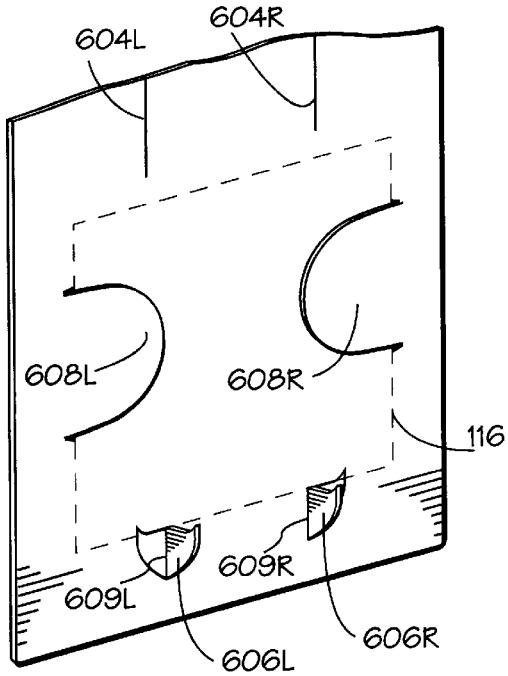

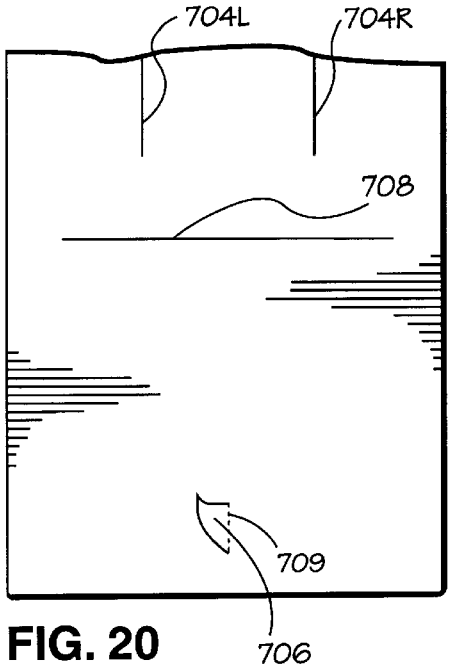
FIG. 20
FIG. 21
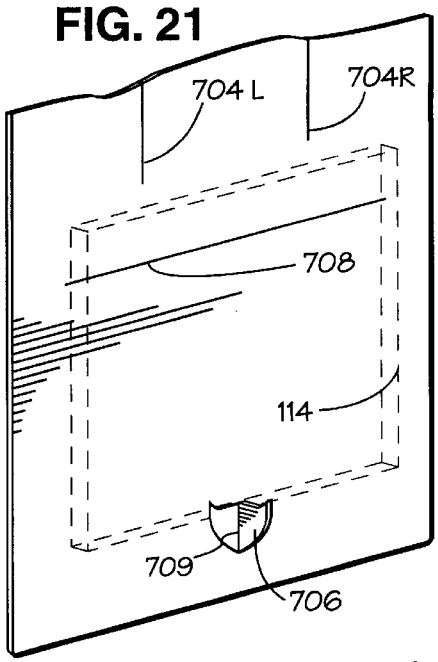
FIG. 22
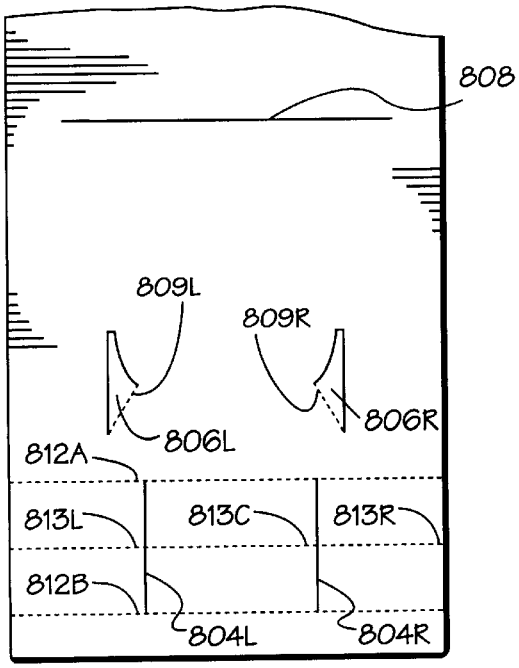
FIG. 23
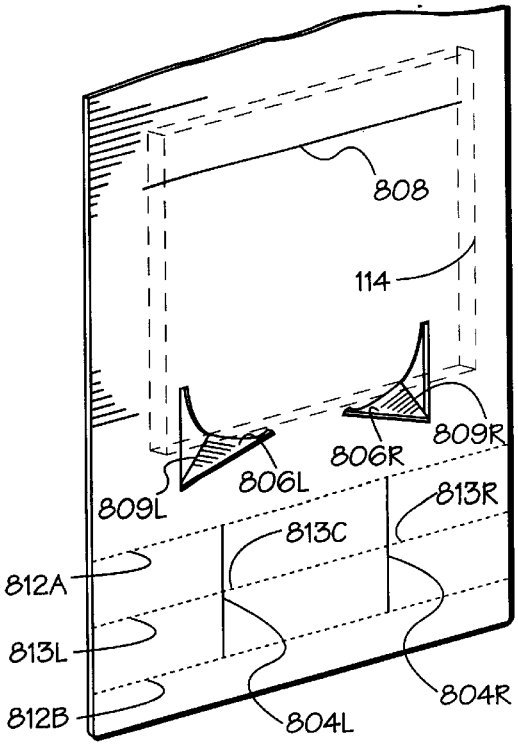

HANGTAG NOTEPAPER DISPENSER AND WRITING INSTRUMENT HOLDER

BACKGROUND

Cross References to Related Applications

This invention uses the transmission of my co-pending applications, Ser. No. 29/079,840, filed Nov. 19, 1997 and Ser. No. 29/083,676, filed Feb. 14, 1998.

Field of Invention

This invention relates to notepaper dispensing hangtags along with provision for holding a writing instrument. While the preferred embodiment contemplates note pads known as "Post-lt"® note pads, a trademark of 3M Company, it can also be used with other pads of pressure sensitive papers secured to each other, or conventional note pads bound at the front end portion for tearing individual or multiple pieces from the same.

Description of Prior Art

Traditionally, the sole purpose of hangtags, such as doorknob hangtags and automobile rear-view mirror hangtags, is for use as a message-carrying device. Doorknob tags are used by commercial institutions such as hotels and motels to communicate with their patrons or vice versa. Delivery services, utility services, and local businesses also use doorknob tags as notices of delivery, service appointment requests or advertising media. Automobile rear-view mirror hangtags are used by commercial institutions as vehicle identification, or by government and health care agencies as handicap user identification.

U.S. Pat. No. 4,216,598 to Newbert (1980) discloses a wind proof doorknob tag which can be used secured on the doorknob shaft with exterior doors but fails to teach or suggest any further uses as a message-carrying device. U.S. Pat. No. 4,862,617 to Cooke which shows different means of attaching a hangtag to an article, makes no proposal to expand the communicative uses of the device.

Hence, the prior art heretofore known suffers from a number of disadvantages and limitations:

(a) Conventional doorknob hangtags used by hotels and motels and rearview mirror hangtags provide only predetermined, printed messages on one or each side of the hangtag.

(b) The same doorknob tags do not provide the flexibility for creating additional and new messages at will.

(c) They provide only a one way communication system that is from the service agent to the patron or vice versa.

(d) They do not provide a means for the message recipient to respond back to the message giver on the same hangtag.

(e) They do not give provision for the message recipient to remove and take the message along while leaving the hangtag in place for further communication needs.

(f) The conventional hangtags are designed for commercial or institutional uses. The practical use of the hangtag in a domestic household and non-commercial environment has been totally ignored.

In a different and unrelated field of products, notepaper dispensers are primarily rectangular, and the pads are secured in an intermediate portion of the dispenser. The majority of the dispensers have a front wall, rear wall and sidewalls to create a recess to accommodate the pad and are designed for use in a horizontal position. While some dispensers permit the pad to be positioned on a vertical plane without the pad falling off from the dispenser, an intermediate medium such as a magnetized pad, an adhesive coating, or a VELCRO® surface is usually required at the underside of the dispenser to mount on a wall, the front of a desk, file or kitchen cabinet, household appliance, and the like. For instance, U.S. Pat. No. 5,480,037 to Pope proposes a vertical mounting dispenser. This dispenser discloses a cumbersome assembly of parts and it requires a separate wall mounting bracket and is therefore limited solely to the location where the bracket is attached to the wall. A complicated pair of leaf-like grips or a pair of "VELCRO"® type loop portion fastener assembly is required to secure the note pad. In addition, a complex assembly of a custom-made spring into a pen slot is necessary for keeping a writing instrument in place. The prior art heretofore known suffers from the following disadvantages and limitations:

(a) The prior art teaches an overly complex design with many intricate components for as simple a device as a notepaper dispenser.

(b) Intricate parts or intermediate components made of a second material are required to grip the note pad in place to prevent dislodgment by jostling or vertical mounting.

(c) Although provision is made in the prior art to accommodate a writing instrument, it teaches too complicated an assembly of positioning an intricate, custom-made mounting spring into a pen slot with spring stop and spring end stops.

(d) It is costly to invest in different tooling to produce all the intricate components necessary for assembly of the dispensers.

(e) It is relatively expensive to actually produce all the components of different materials and additional labor cost is involved in the complex assembly.

(f) The dependence on a wall mounting bracket confines the dispenser to be mounted only on one fixed location. It fails to provide mobility and flexibility of its use in a vertical space-saving mode.

OBJECTS AND ADVANTAGES

Accordingly, several objects and advantages of my invention are:

(a) to provide a message carrying hangtag that allows for creating new and additional messages, in addition to a predetermined printed message if necessary, (b) to provide a message carrying hangtag which can be used as a two-way, interactive communication vehicle;

(c) to provide a message carrying hangtag which allows a user to write down unlimited numbers of new messages;

(d) to provide a message carrying hangtag which allows the intended message recipient to respond back to the message giver on the same hangtag;

(e) to provide a message carrying hangtag which provides for the message recipient to remove and take the message along with him/her while leaving the hangtag in place for further communication needs;

(f) to provide a message carrying hangtag which can be used in a domestic household and non-commercial environment as well as in a commercial or institutional setting.

Other objects and advantages are (a) to provide a message carrying hangtag which is simple in design and whose uses are intuitive and self-explanatory;

(b) to provide a message carrying hangtag which secures a notepaper pad in place with ease of disposal of individual or multiple note sheets;

(c) to provide a message carrying hangtag which carries a writing instrument that is readily usable with the notepaper pad;

(d) to provide a message carrying hangtag which is inexpensive to fabricate and does not involve expensive tooling costs;

(e) to provide a message carrying hangtag which is fabricated from one single thin, flexible, inexpensive material;

(f) to provide a message carrying hangtag which does not require complicated and costly assembly;

(g) to provide a message carrying hangtag with the flexibility and mobility to hang on a vast variety of projections such as doorknobs, cabinet pull handles, door handles, automobile rear-view mirror, etc..

Further objects and advantages of my invention will become apparent from a consideration of the drawings and ensuing description.

BRIEF DESCRIPTION OF THE DRAWINGS

In the drawings, closely related figures have the same number but different alphabetic suffixes.

FIG. 5 is a plan view of the hangtag fully formed from the blank of FIG. 1 in use with writing instrument inserted and notepaper pad secured in place;

FIG. 6 is a top plan view thereof;

FIG. 7 is a side elevation view of FIG. 6 showing part of the last sheet of notepaper protruding out from the back side of the hangtag which is mounted on an automobile rear-view mirror;

FIG. 16 is a fragmentary plan view of the blank structure of another embodiment for forming a hangtag with a tongue to secure the last sheet of notepaper;

FIG. 17 is a fragmentary perspective view thereof showing the last sheet of notepaper secured in place;

FIG. 18 is a fragmentary plan view of the blank structure of yet another embodiment for forming a hangtag thereof with two tongues to secure the last sheet of notepaper;

FIG. 19 is a fragmentary perspective view thereof showing the last sheet of notepaper secured in place;

FIG. 20 is a fragmentary plan view of the blank structure of another embodiment for forming a hangtag thereof with only one flap to support the notepaper pad;

FIG. 21 is a fragmentary perspective view thereof showing a notepaper pad supported by the flap;

FIG. 22 is a fragmentary plan view of the blank structure of yet another embodiment for forming a hangtag with two flaps to support the notepaper pad;

FIG. 23 is a fragmentary perspective view thereof showing the notepaper pad supported by the flaps.

SUMMARY

In accordance with the present invention a hangtag comprises a flat body having an aperture, a pair of spaced-apart slits that hold a writing instrument and at least one flap that is hinged at a fold-line and opens outwardly to support a notepaper pad.

DESCRIPTION OF INVENTION

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
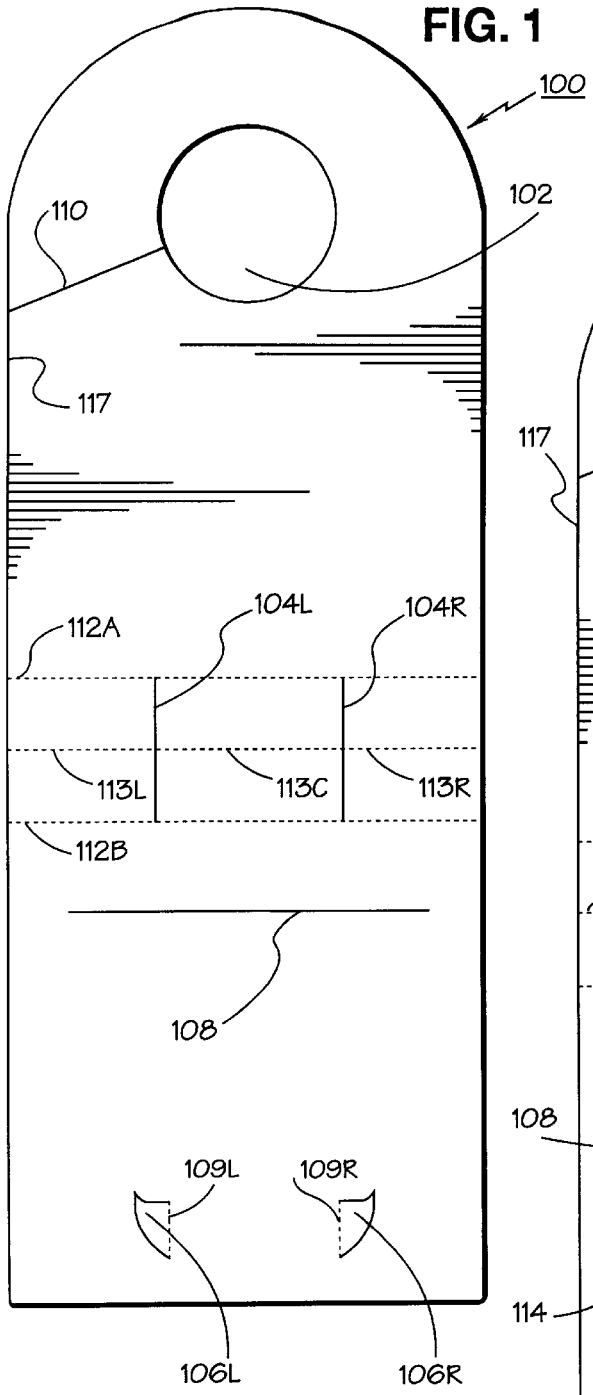
FIG. 1 is a plan view of a blank structure for forming a hangtag according to one embodiment of the present invention.
Figure 2:
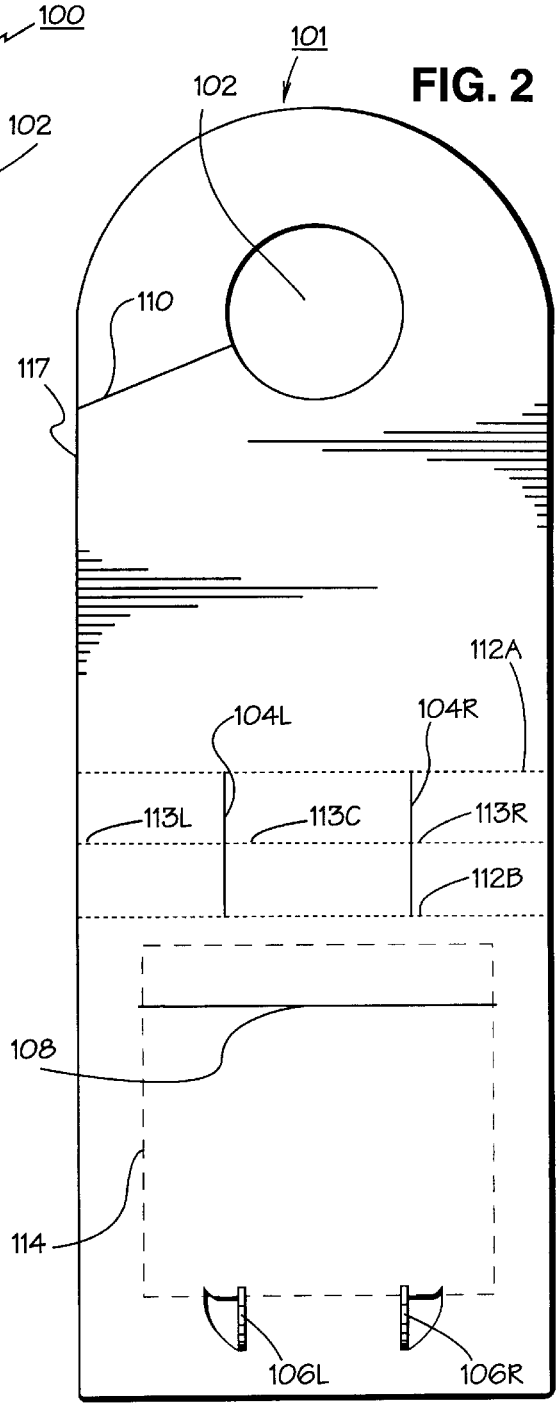
FIG. 2 is a plan view of FIG. 1 showing the hangtag partially formed with two flaps folded outwardly to support a notepaper pad.
Figure 3:
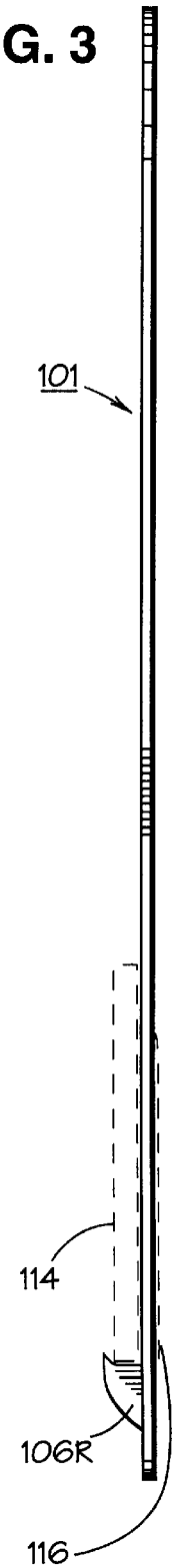
FIG. 3 is a side elevation view of FIG. 2 thereof.
Figure 4:
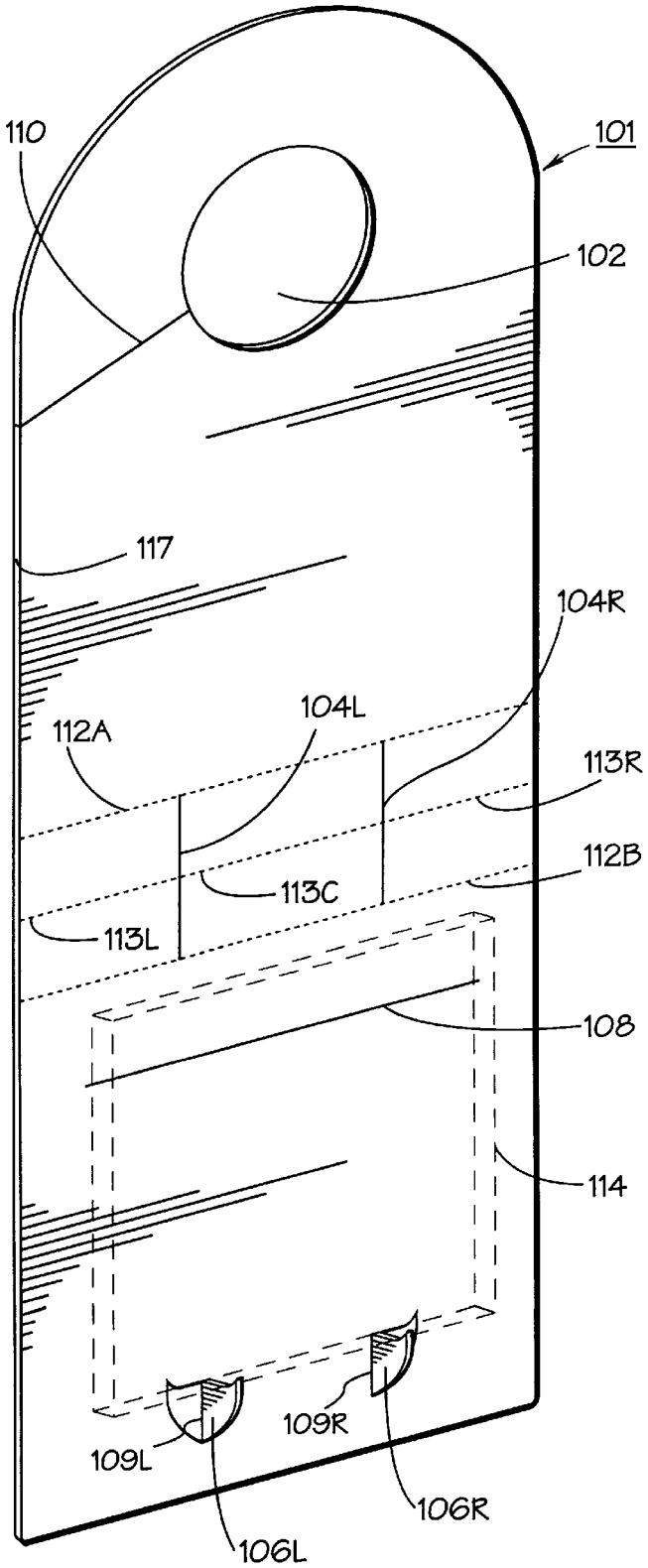
FIG. 4 is a perspective view of FIG. 2 thereof.
Figure 8:
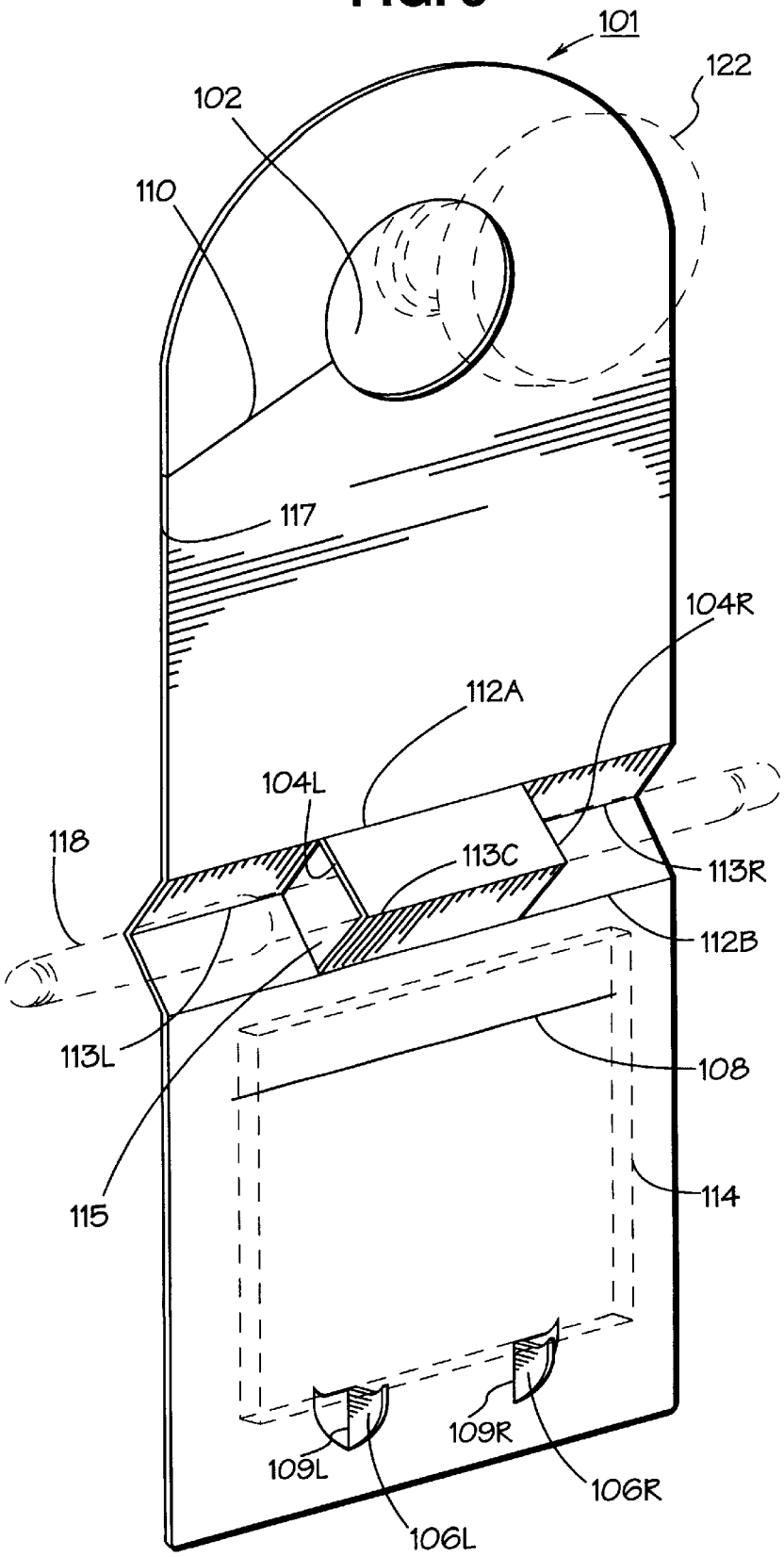
FIG. 8 is a perspective view of FIG. 5 showing the hangtag mounted on a doorknob.

Referring to the drawings in detail, a typical embodiment of the present invention is illustrated in FIGS. 1 to 8. FIG. 1 shows a single-piece cut and scored blank structure 100 for forming a hangtag. The blank 100, designed to permit simple, direct, and rapid manufacture with a minimum of operational steps on a conventional die-cutting press, is a flexible sheet of material of uniform cross section which can be repeatedly bent and folded without fracturing. In the preferred embodiment, the blank is a heavy gauge piece of paper with thin plastic lamination on one side. However, the blank can consist of any other material that can be repeatedly bent and folded without fracturing, such as paper, paper with plastic lamination on one or both sides, cardboard, cardboard with plastic lamination on one or both sides, polyethylene, polyproylene, vinyl, nylon, rubber, leather, various impregnated or laminated fibrous materials, various plasticized materials, etc..

Now referring to FIGS. 2 to 8, a fully formed hangtag 101 consists of three portions which are arranged in, but not necessarily restricted to, the following order: a hanging portion with an aperture 102, a writing instrument holding portion with an opening 115, and a note pad holding portion with a slit 108 and a supporting flap 106L on the left and a supporting flap 106R on the right.

In the hanging portion, aperture 102 is connected to a lead-in slit 110 which extends radially outward towards edge 117 of the blank.

About mid portion of the blank 100 beneath aperture 102 is a straight slit 104L on the left and a straight slit 104R on the right, for forming pen holding opening 115. Both slits 104L and 104R extend longitudinally in a direction away from aperture 102. Traversing and connecting the top of said pair of slits is a horizontal scored fold-line 112A which extends across the entire width of blank 100. Traversing at about the mid-length of the slits is a scored fold-line 113L which originates from edge 117 to extend and terminate at slit 104L. Fold-line 113L is then connected to a central section fold-line 113 C which in turn extends in the same direction and terminates at slit 104R. Likewise, fold-line 113C is again connected by a right fold-line 113R across the remaining span of the blank. All three fold-lines 113L, 113C, and 113R are connected in alignment to form a continuous fold parallel to fold-line 112A. Traversing and connecting the bottom of slits 104A and 104B is yet another scored fold-line 112B which extends across the hangtag identical and parallel to fold-line 112A.

Referring to FIGS. 5 to 8, the pen-holding opening 115 is formed in the following manner: fold-lines 112A and 112B are folded both forward and backward to make them pliable and adaptable. Fold lines 113L and 113R are both folded backward while fold line 113C is folded forward thus expanding fold-lines 113L and 113R in an opposite direction to fold-line 113C to form opening 115.

The remainder of the hangtag constitutes the notepad holding portion. Toward the bottom of the blank are die-cut, fold-out flap 106L on the left and die-cut, fold-out flap 106R on the right. Flap 106L is demarcated therefrom by a scored, hinging fold-line 109L on its right and flap 106R by a scored, hinging fold-line 109R on its left. At a predetermined span above flaps 106L and 106R is horizontal slit 108 which begins at a short space away from edge 117 to extend toward and terminate at an equally short space away from the opposite edge.

Referring to FIGS. 2 to 8, both flaps 106L and 106R are folded outwardly at hinging fold-lines 109L and 109R respectively to form a pair of supporting flaps perpendicular to hangtag 101.

It is to be understood that while certain forms of the present invention have been illustrated and described herein, it is not to be limited to the specific forms or arrangement of parts described and shown.

OPERATION OF INVENTION—FIGS. 2 TO 8

The manner of using the hangtag notepaper holder is intuitive and straightforward.

Last sheet 116 of notepaper is inserted through slit 108 to secure and restrict side shifting of notepad 114 which is then positioned in place to stop at the top edge of fold-out flaps 106L and 106R by pulling last sheet 116 downward towards the end of hangtag 101. If a pressure-sensitive, self-adhering notepad is used, the non-stick liner (not shown) is first removed from the back of the notepad and the top portion of the notepad is pressed against and adhered onto the hangtag after the aforementioned positioning procedure is performed. The top sheet or a plurality of sheets can then be lifted from the notepad at either lower corner of the notepad.

Single or multiple messages can now be created with the note sheets as reminders for oneself, messages to others, or responses back to messages left by others. Written messages can now be taken away by the recipient or be left adhered on the hangtag or on the immediate surrounding area if a self-adhering notepad is used. There is no limit to the number of messages that can be created due to the refillable nature of the notepads which are readily available at stationery stores.

Writing instrument 118 can be readily carried for use at any time with the pad by inserting a pencil, pen, or marker through opening 115. Due to the flexibility of the fold-formed nature of the opening, it is adaptable to accommodate a vast variety of writing instruments of many sizes and shapes. The inserted writing instrument is further secured in place with the closing tension of the opening against the same created by the gravitational pull of the combined weight of the fully assembled hangtag.

For its actual use, the hangtag can be hung onto an appropriate projection by widely opening lead-in slit 110 to pass through the stem of an automobile rear-view mirror 120 or the shaft of a doorknob 122. With the flexibility provided by the aperture 102 with its associated lead-in slit 110, the hangtag can be hung on a wide variety of projections or protrusions in different environments.

DESCRIPTION AND OPERATION–ALTERNATIVE EMBODIMENTS

Figure 9:
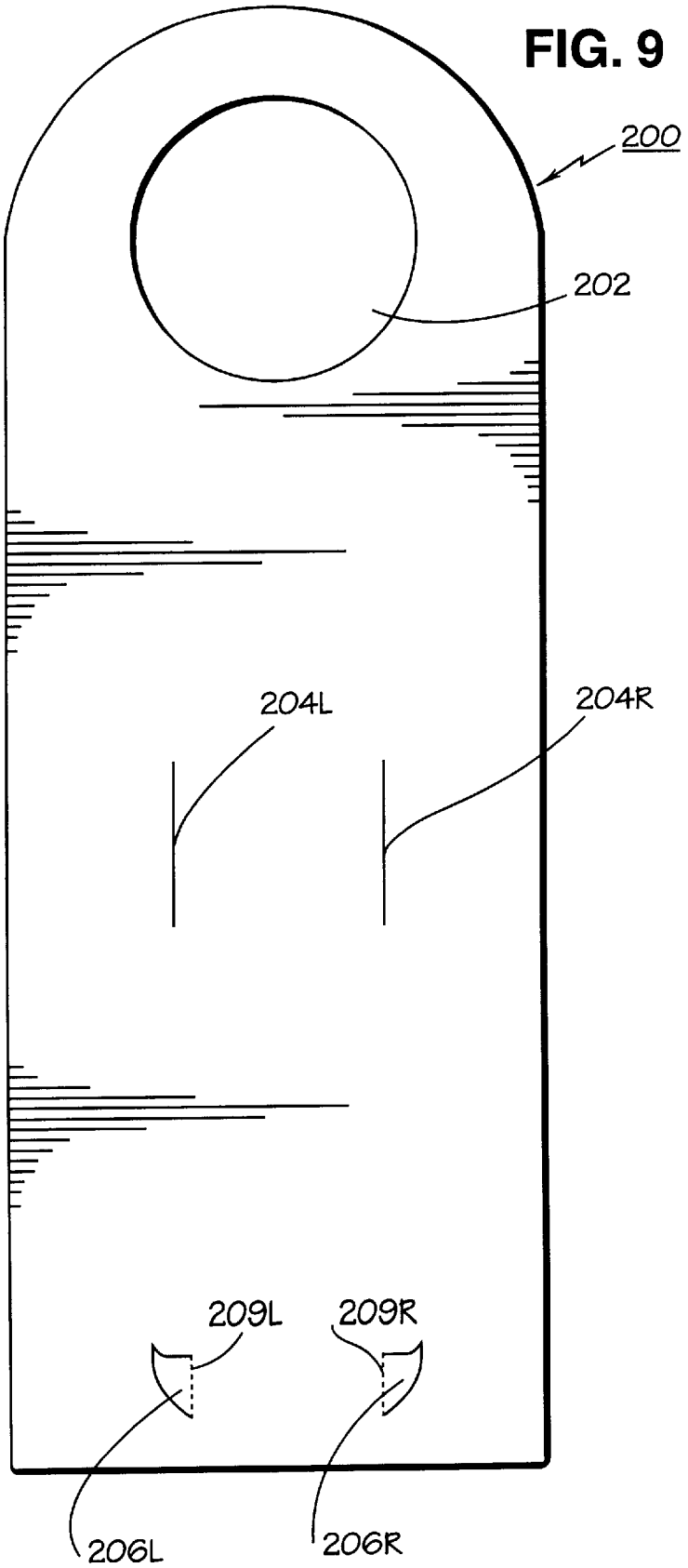
FIG. 9 is a plan view according to an alternative embodiment of the present invention, of a blank structure for forming a hangtag with no lead-in slit to the aperture, no lateral scored fold-lines across the writing instrument slits, and no slit for inserting the last sheet of notepaper.

Referring to an alternative embodiment illustrated in FIGS. 9 to 12:

As shown in FIG. 9, a blank 200 consists of, for the hanging portion on the top, a bigger aperture 202 that is large enough to fit over a normal sized doorknob without lead-in slit; for the pen holding portion, slits 204L and 204R with no connecting fold-lines that traverse across the slits; and for the note pad holding portion a fold-out flap 206L on the left and a fold-out flap 206R on the right, above which there is no traversing slit line for the last note sheet. Each flap has an upwardly turned lip formed at an edge opposite of the hinged fold line.

Figure 10:
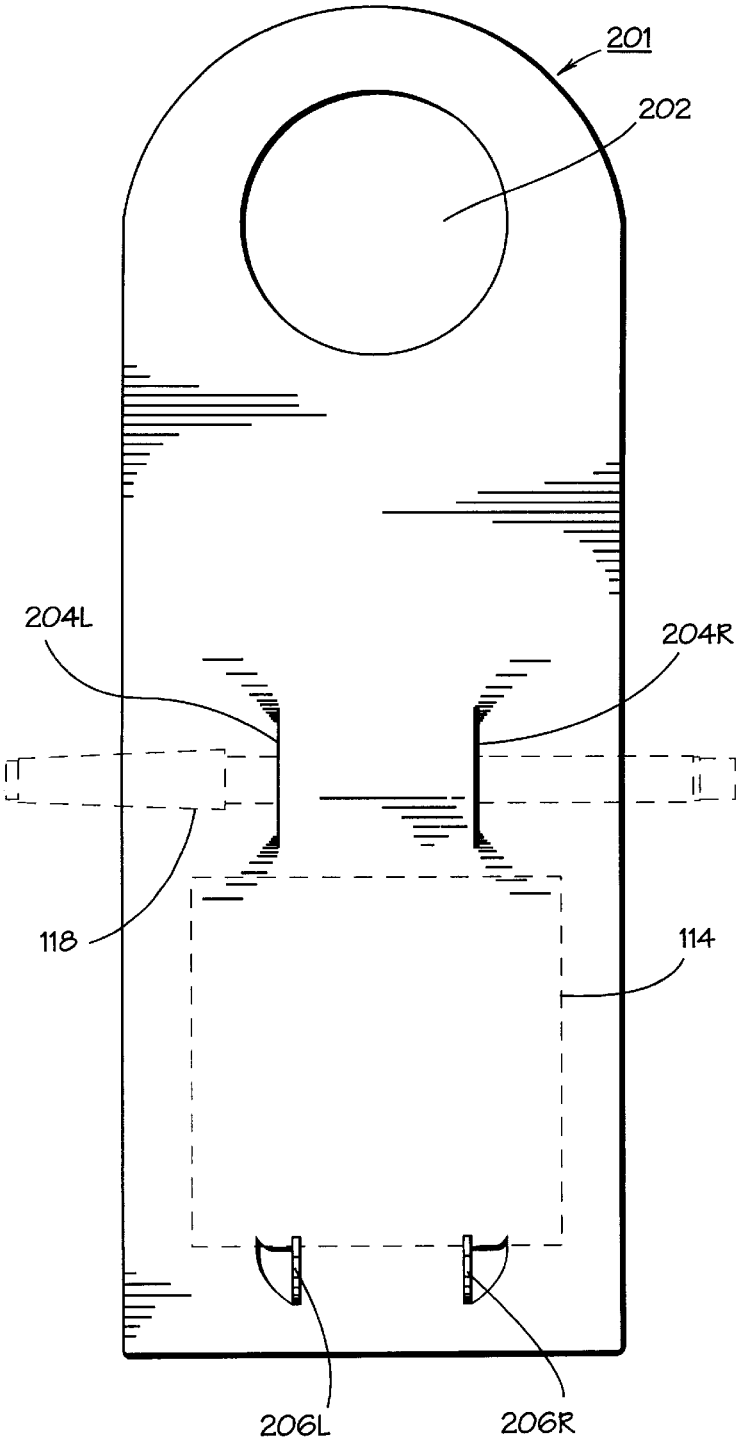
FIG. 10 is a plan view of the hangtag fully formed from the blank of FIG. 9 with writing instrument inserted and notepaper pad secured in place.
Figure 11:
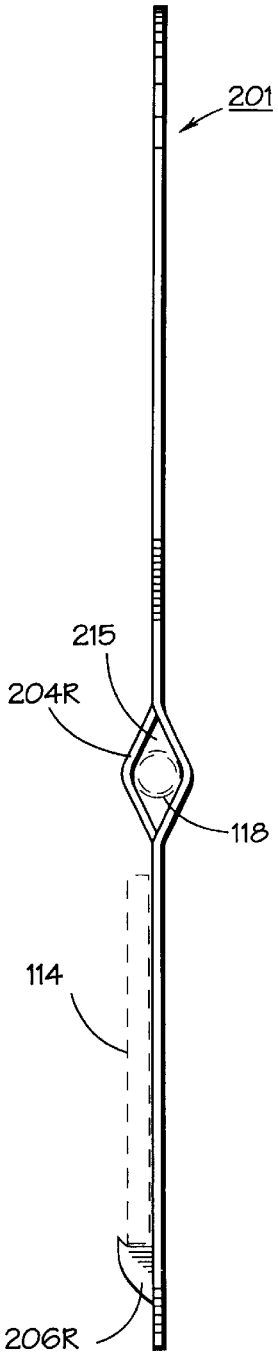
FIG. 11 is a side elevation view thereof.
Figure 12:
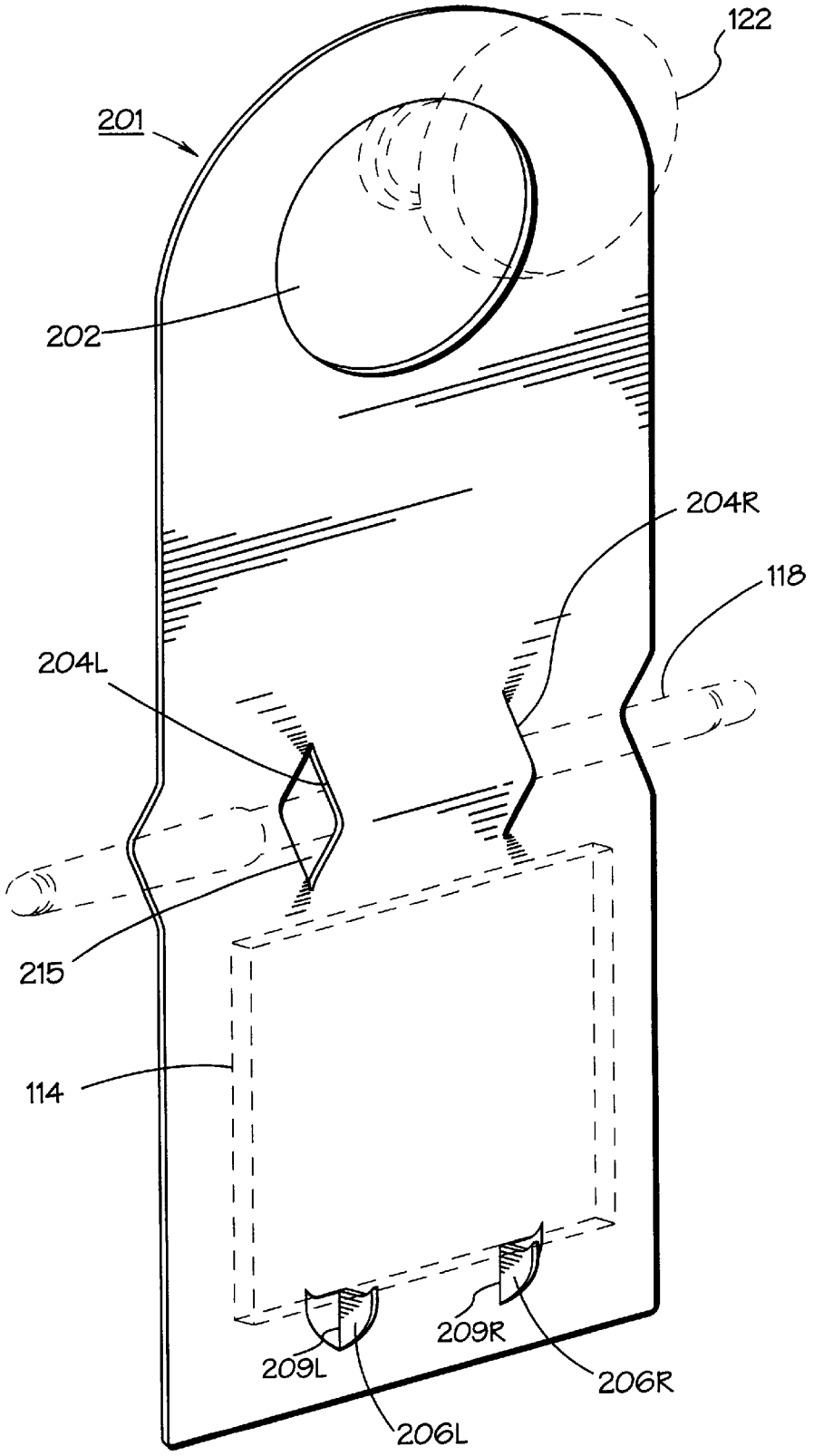
FIG. 12 is a perspective view of FIG. 10 with the hangtag mounted on a doorknob.

Shown in FIGS. 10 to 12 is a fully formed hangtag 201. Self-adhering note pad 114, with its back liner first removed, is positioned and rested on flaps 206L and 206R that fold outwardly along hinging fold-lines 209L and 209R respectively. Pressure is then applied to the top portion of the note pad against hangtag 201 to make it adhere to the hangtag. Writing instrument 118 is lodged in an opening 215 created by slipping the pen through a slit 204L from the left and exiting through a slit 204R on the right, or vise versa. Aperture 202 is slipped over and through a normal sized doorknob 122 and rested on the doorknob shaft. This embodiment, in its use of the three basic elements, aperture 202, slit-lines 204L, 204R, and flaps 206L, 206R to form a functional, single-piece, cut and scored notepaper dispenser hangtag with pen holder, best exemplifies the essence of this invention.

Figure 13:
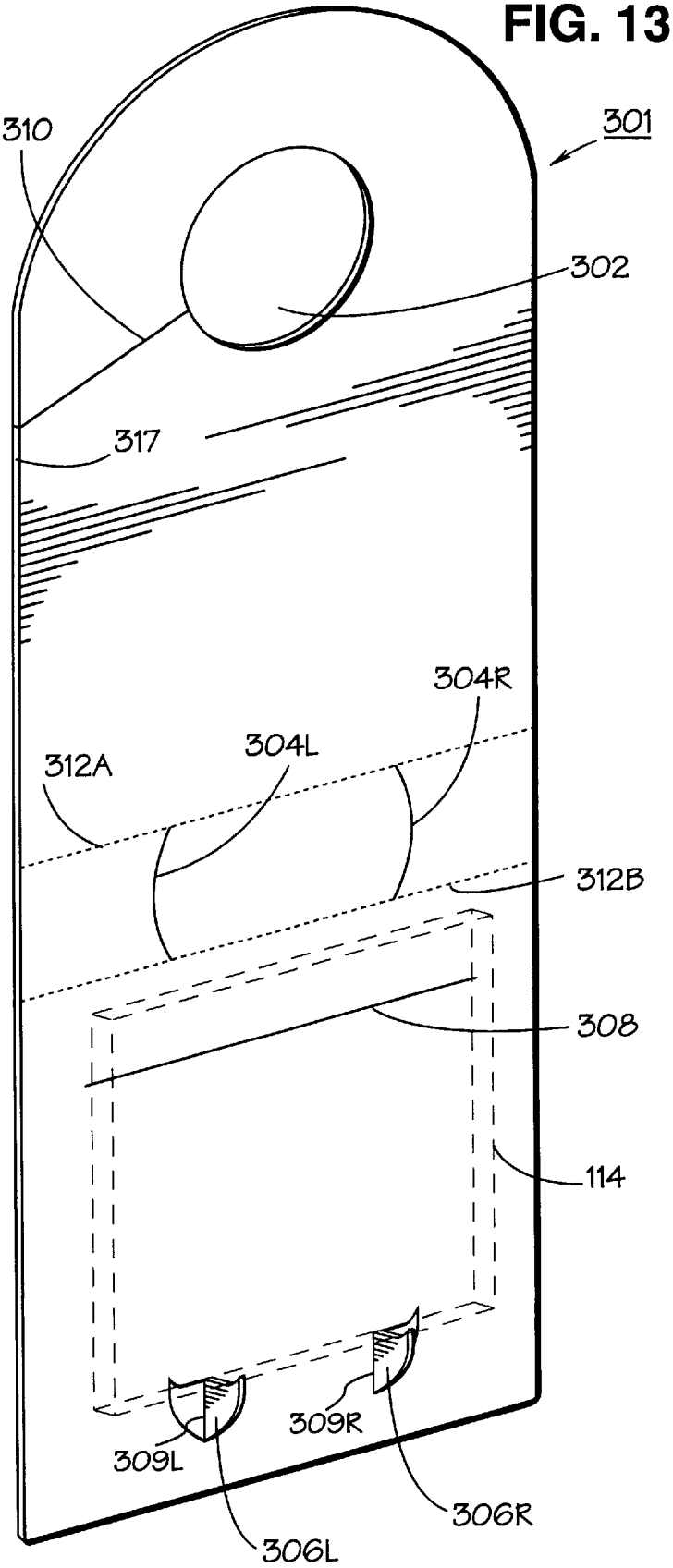
FIG. 13 is a perspective view of yet another embodiment of the hangtag partially formed.
Figure 14:
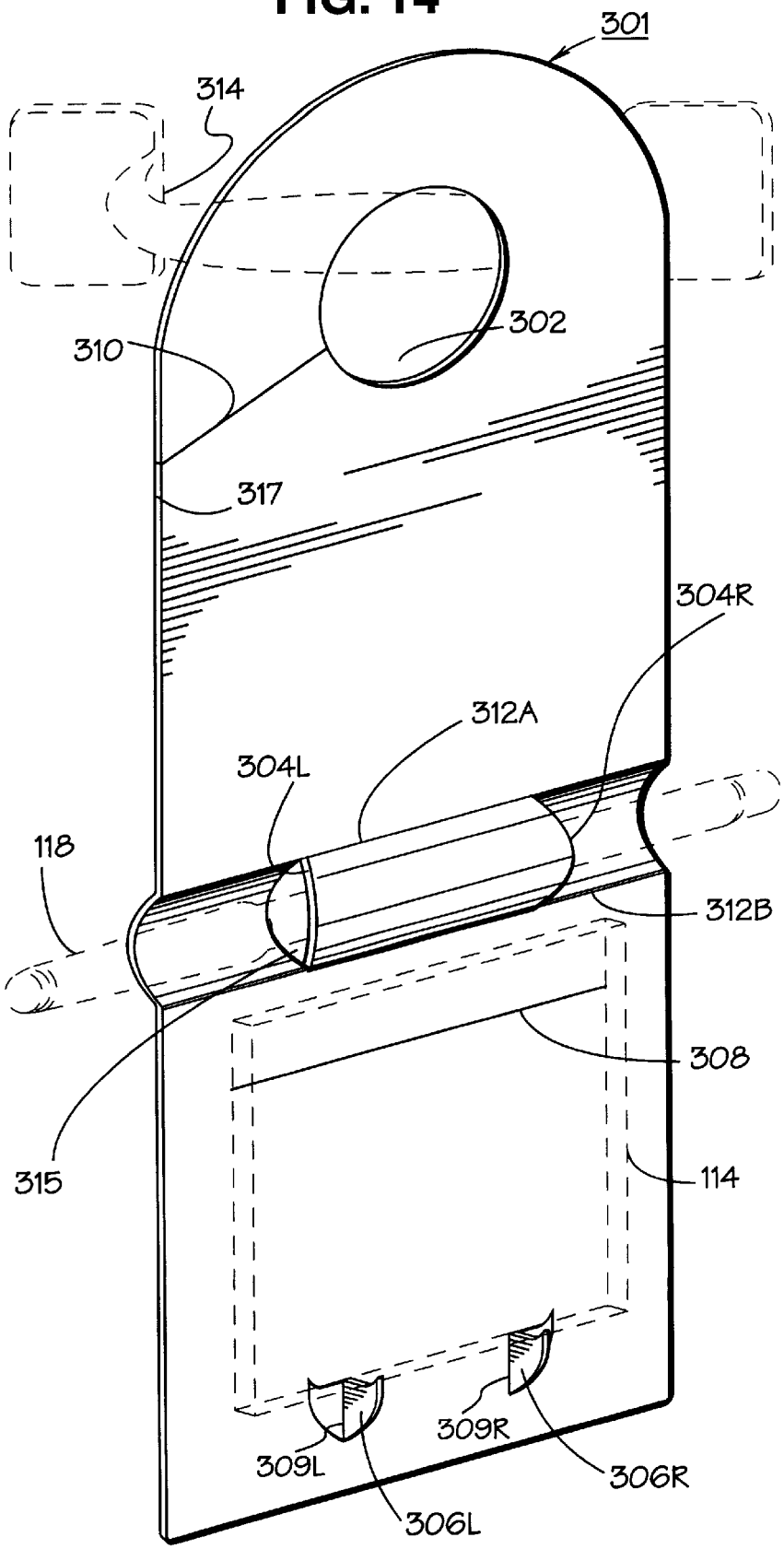
FIG. 14 is a perspective view of FIG. 13 fully formed and mounted on a pull handle with writing instrument inserted and notepaper pad secured in place.

Now referring to yet another embodiment shown in FIGS. 13 and 14 which is very similar to the typical embodiment illustrated in FIGS. 1 to 8: FIG. 13 illustrates a hangtag 301 partially formed with last note sheet (not shown) inserted through a slit 308 and notepad 114 positioned on the top edges of fold-out flaps 306L and 306R folded outwardly along hinging fold-lines 309L and 309R respectively. This embodiment illustrates a pen-holding portion with only two scored fold-lines, fold-line 312A connecting the top and fold-line 312B connecting the bottom of an arch slit 304L on the left and a spaced, opposing arch slit 304R on the right. Fold-lines 312A, 312B traverse from edge 317 on the left to extend across the entire width of the hangtag. As further illustrated in FIG. 14, both fold-line 312A and 312B are folded forward and backward to first make them pliable, then writing instrument 118 is inserted through arch slit 304R to exit through arch slit 304L or vise versa to form an opening 315 to retain said writing instrument.

A lead-in slit 310 is radially connected to aperture 302 to form the hanging portion of the hangtag. Finally the fully assembled hangtag is attached to a pull handle 314. This is accomplished by opening slit 310 wide enough to enclose handle 314 with aperture 302.

Figure 15A:
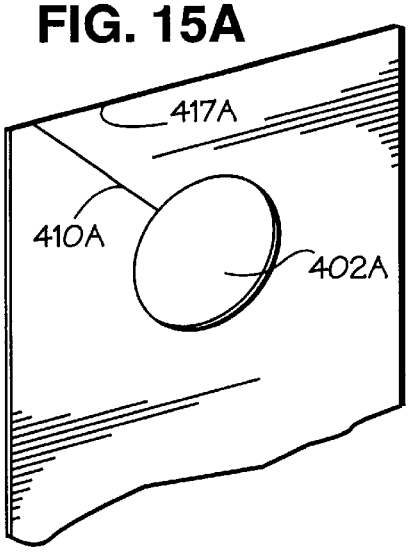
FIG. 15A is a fragmentary perspective view of another embodiment of the hangtag showing an aperture thereof with a lead-in slit.

Now referring to FIGS. 15A to 15H, which are fragmentary views illustrating additional embodiments of the hanging portion of the invention:

FIG. 15A shows an aperture 402A connected to a lead-in slit 410A which extends radially upward towards edge 417A on the top of the hangtag. The aperture is hung on the doorknob (not shown) with slit 410A permitting sufficient opening of aperture 402A for the enlarged end of the knob to pass through.

Figure 15C:
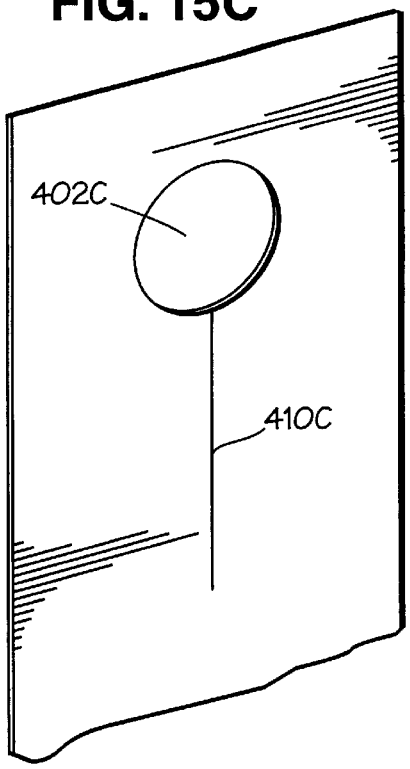
FIG. 15C is a fragmentary perspective view of still yet another embodiment of the hangtag showing an aperture thereof with a vertical lead-in slit.
Figure 15B:
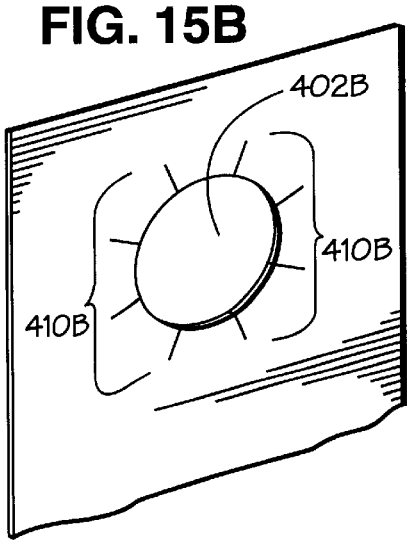
FIG. 15B is a fragmentary perspective view of yet another embodiment of the invention showing an aperture with a plurality of lead-in slits.

FIG. 15B shows an aperture 402B connected to a plurality of lead-in slits 410B which extend radially outward to terminate at predetermined lengths from the aperture. The hangtag is hung on the doorknob shaft (not shown) by spreading open slits 410B to pass and slip said aperture onto the doorknob shaft.

FIG. 15C shows an aperture 402C connected to a lead-in slit 410C which extends radially downward to terminate at a predetermined length away from aperture 402C on the hangtag. The hangtag is attached to a doorknob as previously described.

Figure 15D:
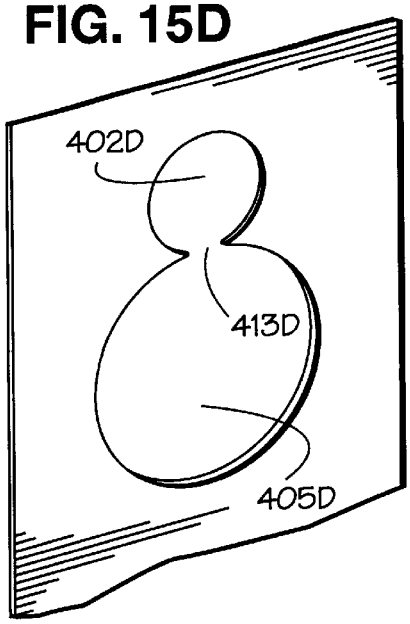
FIG. 15D is a fragmentary perspective view of still yet another embodiment of the hangtag showing an aperture with a combination of two shapes.

FIG. 15D shows a hangtag with an aperture 402D which at its bottom is connected through a gap 413D to the top of a second aperture 405D. Aperture 405D has a predetermined opening sufficient for the enlarged end of the doorknob to pass through. Aperture 402D has a predetermined opening sufficient to accommodate a normal sized doorknob shaft and is hung on the doorknob shaft (not shown) by passing aperture 405D through the doorknob and by pulling the hangtag downward to spread open and pass through gap 413D.

Figure 15E:
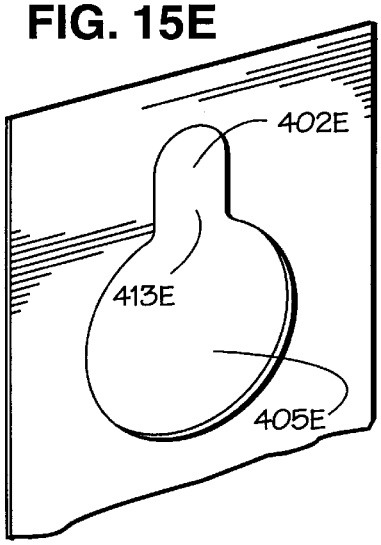
FIG. 15E is a fragmentary perspective view of still yet another embodiment of the hangtag showing an aperture with an alternate combination of two shapes.

FIG. 15E shows a hangtag with an aperture 402E that at its bottom is connected through a channel 413E to a second aperture 405E, whereas channel 413E has a width of the same size as aperture 402E. Aperture 405E has an opening sufficient for the enlarged end of the doorknob to pass through. Aperture 402E is hung on the doorknob shaft (not shown) by first passing aperture 405E through the enlarged end of the doorknob and dropping the hangtag downward to pass channel 413E through the shaft.

Figure 15G:
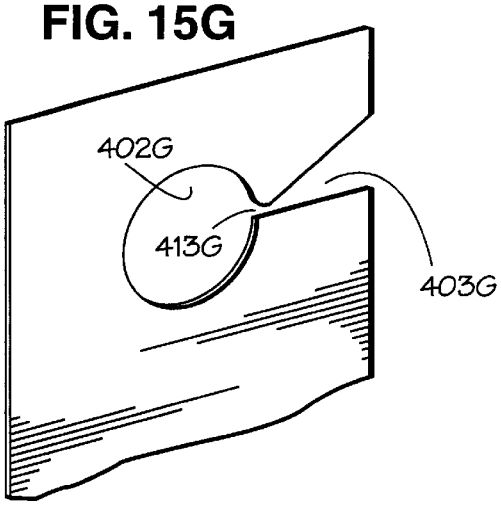
FIG. 15G is a fragmentary perspective view of still yet another embodiment of the hangtag showing an aperture with an alternate side lead-in notch.
Figure 15F:
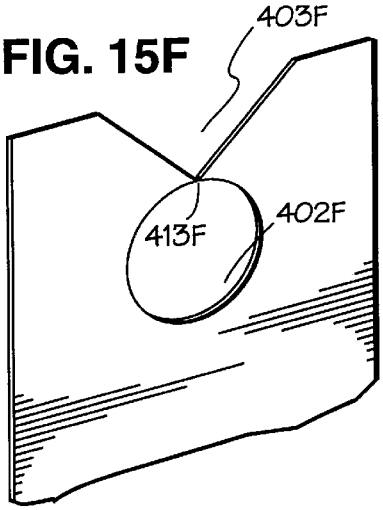
FIG. 15F is a fragmentary perspective view of still yet another embodiment of the hangtag showing an aperture with a top lead-in notch.

FIG. 15F shows a hangtag on the top of which is a lead-in notch 403F that terminates and connects to a gap 413F that leads to an aperture 402F. The hangtag is hung on a doorknob shaft, a rear-view mirror stem, or any other suitable protrusion (none shown) by spreading open notch 403F to pass any of the protrusions through gap 413F.

FIG. 15G shows a hangtag on the side of which is a lead-in notch 403G that terminates and connects to a gap 413G that leads to an aperture 402G. The hangtag is attached to a doorknob or another protrusion as described in the preceding embodiment.

Figure 15H:
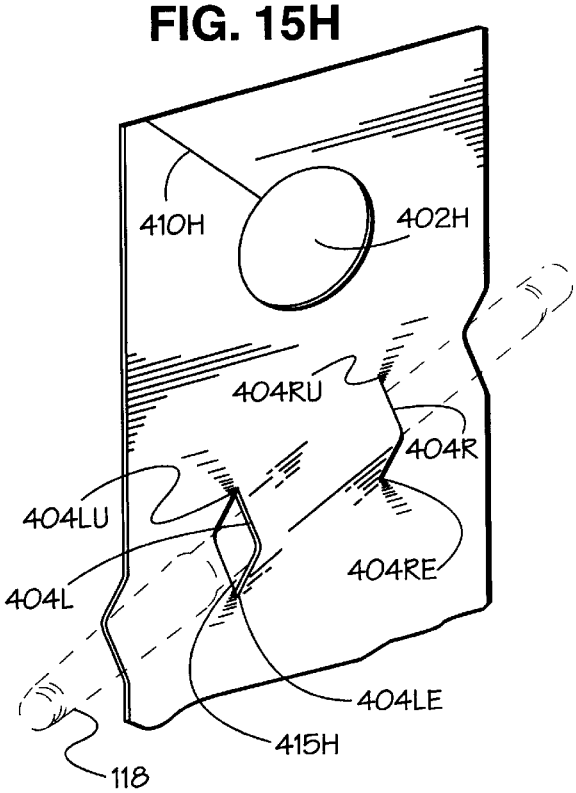
FIG. 15H is a fragmentary perspective view of still yet another embodiment of the hangtag showing two spaced-apart slits with writing instrument inserted in place.

FIG. 15H shows writing instrument or pen 118 being lodged in an inclined opening 415H created by inserting the pen through a pair of spaced-apart, longitudinal slits 404L and 404R. The inclined pen holding slot is created by the use of parallel slits 404L and 404R on the same plane of the body of the hangtag. The lower end point 404LE of slit 404L is positioned at a location lower on the hangtag than the lower endpoint 404RE of slit 404R. Since the slits 404L and 404R are of equal length, the writing instrument or pen is positioned diagonally on the hangtag.

Now referring to FIGS. 16 to 19, which are fragmentary views illustrating additional embodiments of the notepad holding portion of the invention:

FIG. 16 (plan view of a blank) and FIG. 17 (perspective view) show an inverted U-shape cut-line formed tongue 508 which originates from about the top edges of fold-out flaps 506L, 506R and which, at a predetermined space between and away from hinging fold-lines 509L, 509R, extends longitudinally upward to terminate at a predetermined length above fold-lines 506L and 506R. The last sheet of notepaper 116 is inserted behind tongue 508 to secure the note pad (not shown). Fragments of pen holding slits 504L and 504R are shown to illustrate the relative positioning of the last note sheet. Note sheets are dispensed as describe in the typical embodiment.

FIG. 18 and FIG. 19 show another embodiment with an opposing pair of flaps: a C-shape cut-line formed tongue 608R on the right and a reversed C-shape cut-line formed tongue 608L on the left, which are specifically spaced to accommodate the width of the note sheet. These flaps retain the last note sheet 116. The top edges of tongues 608R and 608L are set at a predetermined length above the top edges of flaps 606L and 606R in such a way that there is sufficient length of the last sheet of paper to extend above said top edges. In use, the last sheet of notepaper is inserted behind and through the top edges of tongues 608L and 608R to exit from the bottom edges of the tongues. It is then pulled downward to terminate at flaps 606L and 606R. The latter are folded out at hinging fold-lines 609L and 609R. Fragments of pen holding slits 604L and 604R are shown to illustrate the relative positioning of the last note sheet. Note sheets are dispensed as described in the typical embodiment.

FIG. 20 (plan view of a blank) and FIG. 21 (perspective view) show yet another embodiment whose note pad holding portion consists of only one fold-out flap 706 folded outwardly at hinging fold-line 709 and of a slit 708 similar to that employed in the previously described typical embodiment. Notepad 114 with last note sheet (not shown) is secured and positioned in place in the previously described manner, except in this case is supported by only one fold-out flap 706. Again, fragments of pen holding slits 704L and 704R are shown to illustrate the relative positioning of the note pad.

FIG. 22 and FIG. 23 show yet another embodiment whose note pad holding portion consists of a pair of straight-sided, opposite fold-out flaps 806L, 806R hinged respectively at oppositely inclined fold-lines 809L, 809R. In use, flaps 806L and 806R are folded outwardly along their relative fold-lines to support notepad 114 with last sheet (not shown) secured through a slit 808 in the previously described manner. Note that this particular embodiment illustrates the alternate arrangement of placing the pen holding portion beneath the notepad holding portion. For the purpose of giving more visual emphasis on the said supporting flaps, the pen holding portion, which consist of slits 804L, 804R and traversing fold-lines 812A, 812B, 813L, 813C, and 813R, is shown as part of a blank. When in use, this portion is formed in the same manner as previously described.

CONCLUSION, RAMIFICATIONS, AND SCOPE OF INVENTION

Accordingly, the reader will see that the hangtag notepaper holder of this invention provides a highly efficient, well organized, lightweight, yet extremely economical device that can be used in commercial, institutional, and domestic environments as a device for interactive communication. The hangtag nature of the invention makes the device very flexible and mobile for moving from one environment to another.

While my above description contains many specificities, these should not be construed as limitations on the scope of the invention, but rather as illustrations of some of the presently preferred embodiments thereof. Many other variations are possible. For example, the outer configuration of the hangtag can have different geometric shapes, such as oval, trapezoidal, triangular, or a combination of different geometric shapes, or of organic, irregular shapes, or a combination of organic, irregular, and geometric shapes, etc.; the lead-in slit or lead-in notch can have other shapes from different directions; the aperture can have different shapes other than circular, similar to suggestions for the hangtag configuration; the notepad supporting flaps as well as the last sheet securing flaps can have other shapes; the last sheet inserting slit can have other delineations; the pen holding slits can have other delineations; and the hanging portion, the pen holding portion, and note pad holding portion can be arranged in different orders, etc.. Furthermore, as illustrated in the embodiment in FIGS. 9 to 12, the size of the aperture can be made smaller or larger; lead-in slits can be eliminated; traversing fold-lines connecting through pen holding slits can be eliminated; the last note sheet securing slit can be eliminated, etc. In addition, the hangtag notepaper holder can be used in different indoor and outdoor environments other than those previously mentioned.

Accordingly, the scope of the invention should be determined not by the embodiments illustrated, but by the appended claims and their legal equivalents.

I claim:

1. A hangtag for holding a writing instrument and a note pad of the type comprising a flat body of material having three integrally connected portions:

(a) a hanging portion including an aperture, (b) a writing instrument holding portion including a pair of spaced-apart longitudinal slits, (c) a note pad holding portion including at least one integral fold-out flap with a side-connecting, hinging fold-line within said body, (d) an upwardly turned lip formed at an edge opposite of the hinging fold line.

2. The hangtag of claim 1 wherein said body is elongated.

3. The hangtag of claim 1 wherein said aperture is of a predetermined and sufficient size to accommodate the knob portion of a normal sized doorknob.

4. The hangtag of claim 1 wherein the edges of said aperture are spaced from the edges of the top portion of the body.

5. The hangtag of claim 1 wherein said slits are spaced from the edges of the mid portion of the body.

6. The hangtag of claim 1 wherein said slits are spaced at a predetermined distance from said aperture.

7. The hangtag of claim 1 wherein said note pad holding fold-out flap is at about the lower portion of the body, said flap being folded forwardly relative to the body at one side for receiving and supporting the bottom edge of a pressure-sensitive, self-adhering note pad thereon.

8. The hangtag of claim 1 wherein said note pad holding fold-out flap is spaced at a predetermined distance from said slits.

9. The hangtag of claim 1 wherein said aperture is of a predetermined and sufficient size to accommodate the shaft portion of said normal sized doorknob.

10. The hangtag of claim 9 wherein said aperture is connected to a lead-in slit, said lead-in slit extending radially outward toward an outside edge of said body.

11. The hangtag of claim 1 wherein said note pad holding portion includes two spaced-apart, opposed fold-out flaps, each said flap being connected at one side to a longitudinal hinging fold-line within said body therein.

12. The hangtag of claim 1 wherein said body of material is composed of paper cardboard.

13. A method of making a hangtag for holding a writing instrument and for supporting a pressure-sensitive, self-adhering note pad on said hangtag comprising of:

(a) providing a hangtag with an aperture of a predetermined size to accommodate an intended protrusion, (b) providing a hangtag with a pair of longitudinally spaced-apart slits for receiving, by insertion, an intended writing instrument, (c) providing a hangtag with at least one fold-out flap with a side-connecting hinging hold-line for receiving and supporting the bottom edge of an intended pressure-sensitive, self-adhering note pad, (d) providing an upwardly turned lip formed at an edge opposite of the hinging fold line.

14. A hangtag for inserting a writing instrument and supporting a note pad of the type comprising a flat body of material having three integrally connected yet spaced-apart portions:

(a) a hanging portion comprising an aperture, (b) a note pad supporting portion comprising at least one die-cut flap, said flap being folded out at one side along a hinging fold-line within said body, (c) a writing instrument inserting portion comprising a pair of spaced-apart longitudinal slits, (d) an upwardly turned lip formed at an edge opposite of the hinging fold line.

* * * * *